US006902495B2

(12) United States Patent
Pergande et al.

(10) Patent No.: US 6,902,495 B2
(45) Date of Patent: Jun. 7, 2005

(54) GOLF CLUB VIBRATION DAMPENING AND SOUND ATTENUATION SYSTEM

(75) Inventors: Jon C. Pergande, Palatine, IL (US); Jeffrey D. Sheets, Aurora, IL (US); Frank Garrett, Jr., Barrington, IL (US); Richard P. Hulock, Naperville, IL (US); Mark W. Lin, Hinsdale, IL (US)

(73) Assignee: Wilson Sporting Goods Co., Chicago, IL (US)

( * ) Notice: Subject to any disclaimer, the term of this patent is extended or adjusted under 35 U.S.C. 154(b) by 0 days.

(21) Appl. No.: 09/916,450

(22) Filed: Jul. 27, 2001

(65) Prior Publication Data

US 2003/0022729 A1 Jan. 30, 2003

(51) Int. Cl.[7] ..... A63B 53/04

(52) U.S. Cl. ..... 473/332; 473/329; 473/338; 473/350; 473/334

(58) Field of Search ..... 473/332, 350, 473/324, 329, 347, 330

(56) References Cited

U.S. PATENT DOCUMENTS

| | | | | |
|---|---|---|---|---|
| 2,846,228 | A | 8/1958 | Reach | |
| 4,740,345 | A | 4/1988 | Nagasaki et al. | 264/257 |
| 4,811,950 | A | 3/1989 | Kobayashi | 273/171 |
| 4,848,747 | A | 7/1989 | Fujimara et al. | 273/77 |
| 4,865,345 | A | 9/1989 | Piegay | 280/602 |
| 4,928,972 | A | 5/1990 | Nakanishi et al. | 273/78 |
| 4,964,640 | A | 10/1990 | Nakanishi et al. | 273/167 |
| 5,277,423 | A | 1/1994 | Artus | 273/80 |
| 5,282,625 | A | 2/1994 | Schmidt et al. | 273/167 |
| 5,290,036 | A | 3/1994 | Fenton et al. | 273/167 R |
| 5,294,119 | A | 3/1994 | Vincent et al. | 273/80 |
| 5,299,807 | A | 4/1994 | Hutin | 273/173 |
| 5,316,298 | A | 5/1994 | Hutin et al. | 273/78 |
| 5,409,229 | A | 4/1995 | Schmidt et al. | 273/167 |
| 5,478,075 | A | 12/1995 | Saia et al. | 273/81 |
| 5,540,436 | A | 7/1996 | Boone | 473/350 |
| 5,575,722 | A | 11/1996 | Saia et al. | 473/300 |
| 5,586,947 | A | 12/1996 | Hutin | 473/324 |
| 5,605,511 | A | 2/1997 | Schmidt et al. | 473/324 |
| 5,653,643 | A | 8/1997 | Falone et al. | 473/300 |
| 5,665,975 | A | 9/1997 | Kedar | 250/573 |
| D385,006 | S | 10/1997 | Sims | D21/221 |
| 5,692,971 | A | 12/1997 | Williams | 473/318 |
| 5,718,643 | A | 2/1998 | Wright et al. | 472/297 |
| 5,735,752 | A | 4/1998 | Antonius | 473/317 |
| 5,759,113 | A | 6/1998 | Lai et al. | 473/321 |
| 5,788,586 | A | 8/1998 | Macioce | 473/318 |
| 5,902,656 | A | 5/1999 | Hwang | 428/36.91 |
| 5,944,619 | A | 8/1999 | Cameron | 473/332 |
| 6,042,485 | A | 3/2000 | Cheng | 473/318 |
| 6,080,069 | A | 6/2000 | Long | 473/332 |
| 6,117,018 | A | 9/2000 | Tanada | 464/183 |
| 6,592,468 | B2 * | 7/2003 | Vincent et al. | 473/334 |
| 2002/0065144 | A1 | 5/2002 | Helmstetter et al. | 473/332 |

* cited by examiner

*Primary Examiner*—Glenn Caldarola
*Assistant Examiner*—Tom P Duong
(74) *Attorney, Agent, or Firm*—Terence P. O'Brien

(57) ABSTRACT

A golf club vibration dampening and sound attenuation system including an elongated shaft, a club head, a resilient insert assembly, a dampener, and a grip. The shaft has a distal shaft end and a proximal shaft end. The club head is coupled to the distal shaft end, and includes a front wall and a sole portion. The front wall has a rearwardly sloped front strike side and a rear side. The sole portion rearwardly extends from a lower region of the rear side. The rear side and the sole portion define a cavity and a recess. The recess downwardly extends into the sole portion. A resilient insert assembly is positioned in and substantially fills the recess. The insert assembly is coupled to one or both of the sole portion and the lower region. The dampener is disposed within the shaft and has at least one annular radially extending projection.

25 Claims, 12 Drawing Sheets

GOLF CLUB VIBRATION DAMPENING AND SOUND ATTENUATION SYSTEM

FIELD OF THE INVENTION

The present invention relates generally to an improved golf club. In particular, the present invention relates to a golf club vibration dampening and sound attenuation system.

BACKGROUND OF THE INVENTION

Golf clubs are well known and typically include a hollow shaft having a club head mounted at one end and a grip mounted at the other end. The club head typically includes a rearwardly inclined front strike face. A central region of the strike face, commonly referred to as the "sweet spot," generally provides the best overall response and the best coefficient of restitution when impacting a golf ball. When a user impacts a golf ball at the sweet spot of the golf club, the club typically generates a distinctive clean sound and provides a comfortable "solid hit" feel for the user.

It is not uncommon for a substantial amount of vibration to be generated from the club head upon striking a golf ball, particularly where the point of the impact occurs away from the sweet spot. Such an off-center impact can produce an undesirable pattern of flexure of the golf club which can be characterized as a traveling shock wave through the club and/or as a translationally or rotationally applied force that typically travels from the club head, up the shaft, and to the grip, where it is felt by the user. This vibration can be harsh and uncomfortable to certain users. At a minimum, the vibration can negatively affect the user's feel of the golf club and can provide the user with a negative impression of the golf club.

Additionally, some golf clubs, particularly during off-center contact with a golf ball, generate undesirable sounds such as ringing sounds or unusually loud sounds. These undesirable sounds can be unpleasant, irritating and even embarrassing to the user. Further, it is generally known that the shock or vibration imparted to the user's hands, and the undesirable sounds emitted from off-center impacts, can decrease the user's confidence level and may, over time, negatively affect the user's performance.

Thus, there is a continuing need for a golf club that minimizes the amount of vibration felt by the user during use, particularly during off-center contact with the ball. There is also a continuing need for a golf club that provides a user with an improved feel and a more pleasant experience during use. What is needed is a golf club that can eliminate or significantly reduce undesirable sounds or audible vibrations during impact with a golf ball. Moreover, it would be advantageous to provide a golf club that includes more than one vibration and sound dampening mechanisms. It would also be advantageous to provide a vibration dampening and sound attenuation mechanism that can be easily installed, is lightweight, and does not adversely affect the performance of the golf club.

SUMMARY OF THE INVENTION

The present invention provides a golf club head including a front wall, a sole portion and a resilient insert assembly. The front wall has a rearwardly sloped front strike side and a rear side. The rear side includes an upper region and a lower region. The sole portion rearwardly extends from the lower region of the rear side. The rear side and the sole portion define a forwardly extending cavity and a recess.

The recess downwardly extends into the sole portion and interconnects with the cavity. The resilient insert assembly is positioned in and substantially fills the recess. The upper region of the rear side is generally uncovered. The insert assembly is coupled to one or both of the sole portion and the lower region of the rear side. The insert assembly is fabricated of at least one material having a durometer of between 20 on a Shore A hardness scale and 75 on a Shore D hardness scale.

According to a principal aspect of a preferred form of the invention, a golf club head includes a front wall, a sole portion, and first and second inserts. The front wall has a rearwardly sloped front strike side and a rear side. The sole portion rearwardly extends from a lower region of the rear side. The rear side and the sole portion define a forwardly extending cavity and a recess. The recess interconnects with the cavity and downwardly extends into the sole portion. The second insert contacts the first insert. The first and second inserts are positioned in and collectively substantially fill the recess. One or both of the first and second inserts are attached to one or both of the sole portion and the lower region of the rear side. The first and second inserts are made of first and second elastomeric materials, respectively.

According to another preferred aspect of the invention a vibration dampener of unitary construction is configured for placement within a shaft of a golf club. The shaft has an inner surface. The dampener includes a cylindrical member, at least one annular projection, and at least one grouping of two or more fins. The annular projection radially extends from the member. The grouping of two or fins radially extends from the member to define at least two slots spacing apart the fins.

According to another preferred aspect of the invention a golf club vibration dampening and sound attenuation system is provided. The system includes an elongated shaft, a club head, a resilient insert assembly, a dampener, and a grip. The shaft has a distal shaft end and a proximal shaft end. The club head is coupled to the distal shaft end. The club head includes a front wall and a sole portion. The front wall has a rearwardly sloped front strike side and a rear side. The sole portion rearwardly extends from a lower region of the rear side. The rear side and the sole portion define a forwardly extending cavity and a recess. The recess downwardly extends into the sole portion. A resilient insert assembly is positioned in and substantially fills the recess. The insert assembly is coupled to one or both of the sole portion and the lower region of the rear side. The dampener is disposed within the shaft. The dampener is a cylindrical member having at least one annular radially extending projection. The grip is mounted to the proximal shaft end.

According to another preferred aspect of the invention a tool for installing a dampener within a shaft wherein the dampener has a bore. The tool includes a handle portion, a distal pin portion and a central portion. The distal pin portion is removably insertable within bore of the dampener. The central portion is connected at a first end to the distal pin portion and is coupled at a second end to the handle portion. The central portion is configured to bear against the dampener during installation.

This invention will become more fully understood from the following detailed description, taken in conjunction with the accompanying drawings described herein below, and wherein like reference numerals refer to like parts.

DETAILED DESCRIPTION OF THE PREFERRED EMBODIMENTS

Figure 1:
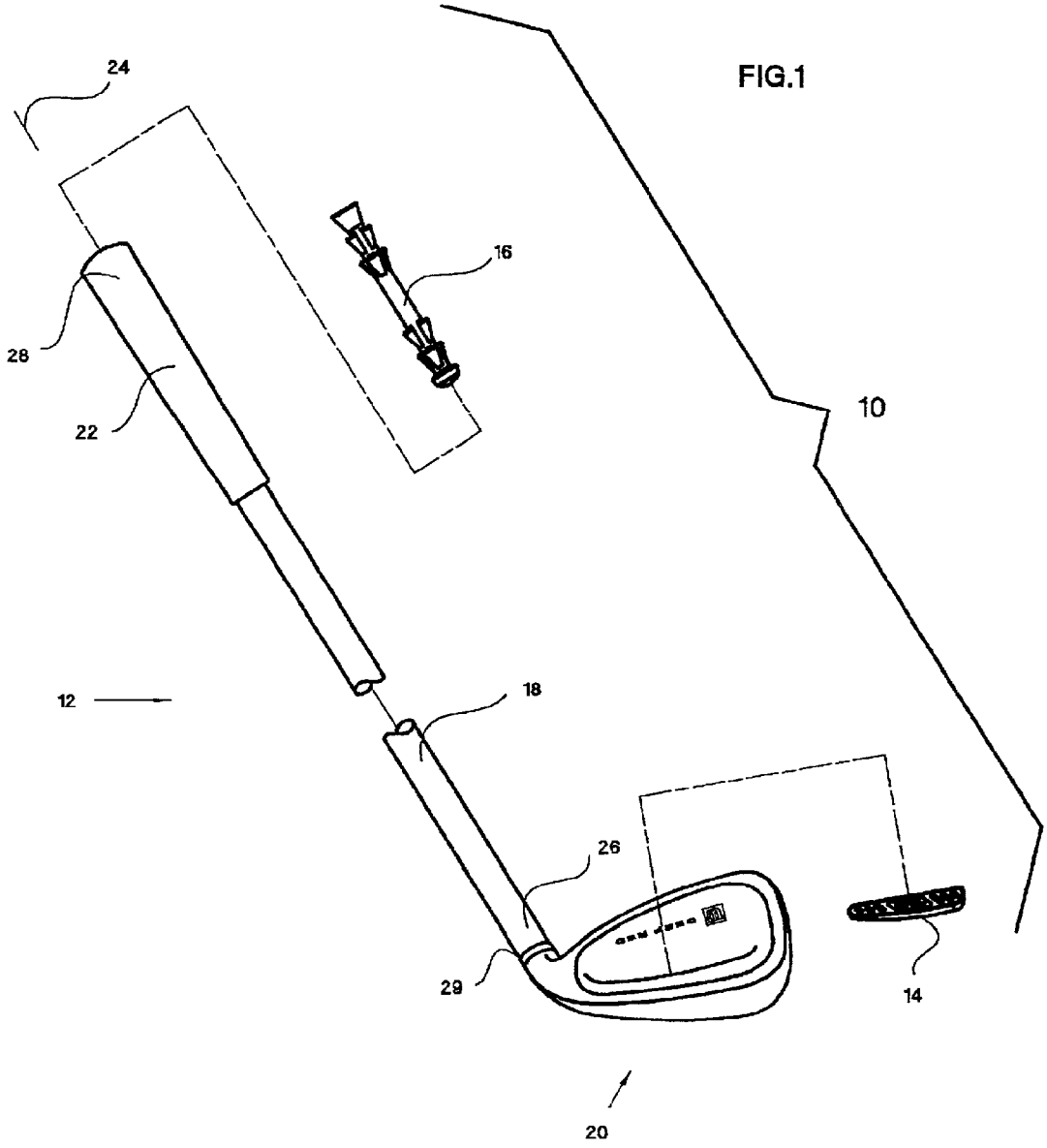
FIG. 1 is an exploded rear view of a golf club vibration dampening and sound attenuating system in accordance with a preferred embodiment of the present invention.

Referring to FIG. 1, a golf club vibration dampening and sound attenuation system is indicated generally at 10. The system 10 includes a golf club 12, a club head insert assembly 14 and a club shaft dampener 16. The golf club 12 of FIG. 1 is configured as a #1 iron type club of a set. The present invention can also be formed as, and is directly applicable to, a #2 through #9 iron club through the variation of certain golf club parameters, such as, for example, varying the inclination angle of the club head front strike face and varying the length of the club shaft.

The golf club 12 includes a shaft 18, a club head 20 and a grip 22. The shaft 18 is an elongate tube extending along a longitudinal axis 24. The shaft 18 has a distal end 26, which is coupled to the club head 20, and a proximal end 28, which is slidably connected to the grip 22. The shaft 18 is made of a generally lightweight, strong material, preferably graphite or steel. Alternatively, the shaft can be formed of other materials, such as, for example, other metals, alloys or composites. In a preferred embodiment, the shaft 18 includes an inward taper that generally extends from the proximal end 28 to the distal end 26. Alternatively, the shaft 18 can be formed having a uniform diameter along the axis 24.

The club head 20 is generally planar body that is coupled the shaft 18. Preferably, the club head 20 is affixed to the shaft 18 with an epoxy adhesive. A ferrule 29 is used to generally cover the connection. The club head 20 is formed of a high tensile strength, durable material, preferably stainless steel. Alternatively, the club head 20 can be formed of other materials such as, for example, metals, alloys, ceramics or composites.

The grip 22 is a conventional handle structure of generally hollow construction. The grip 22 has an open end configured for slidably receiving the proximal end 28 of the shaft 18. The grip 22 is formed of a generally soft resilient material, such as, for example, rubber, polyurethane, leather, a thermoplastic or an elastomer. Alternatively, the grip 22 can be formed of two or more layers of material. In yet another alternative embodiment, the grip 22 be can formed by wrapping of one or more tapes about the proximal end 28 of the shaft 18.

The insert assembly 14 of the system 10 is a resilient elongate body that is connected, preferably with an adhesive, to the club head 20. The insert assembly 14 is configured to reduce the shock or vibration felt by a user holding the grip 22 of the club 12 when striking a golf ball (not shown), particularly during off-center impacts. The insert assembly 14 absorbs and dissipates at least a portion of the vibrational energy generated during impact with a golf ball. The absorption and dissipation of energy by the insert assembly 14 produces a more comfortable "feel" for the user. The insert assembly 14 is also configured to reduce the sound generated from the club head 20 upon impact with a golf ball. Moreover, the absorption and dissipation of vibrational energy by the insert assembly 14 attenuates the audible vibrations emitted from the golf club 12 resulting in a more pleasing, cleaner sound upon impact.

The dampener 16 of the system 10 is an elongate cylindrical member. The dampener 16 is configured to be slidably and securely inserted into the shaft 18. The dampener 16 is further configured to reduce at least a portion of the vibrational energy traveling up the shaft 18 of the club 12 following impact with a golf ball. The dampener 16 is also configured to improve the feel of the club 12 to the user and the sound produced by the club 12 upon impacting a golf ball, particularly during off-center impacts of a golf ball.

Figure 2:
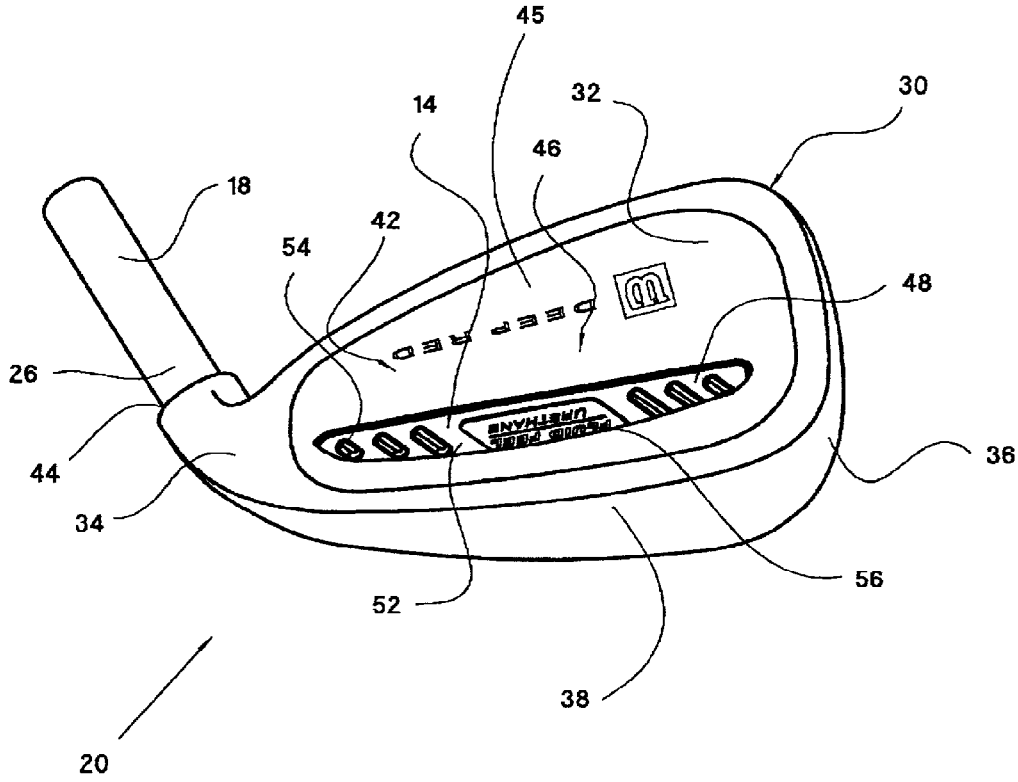
FIG. 2 is a rear perspective view of a club head of FIG. 1.
Figure 3:
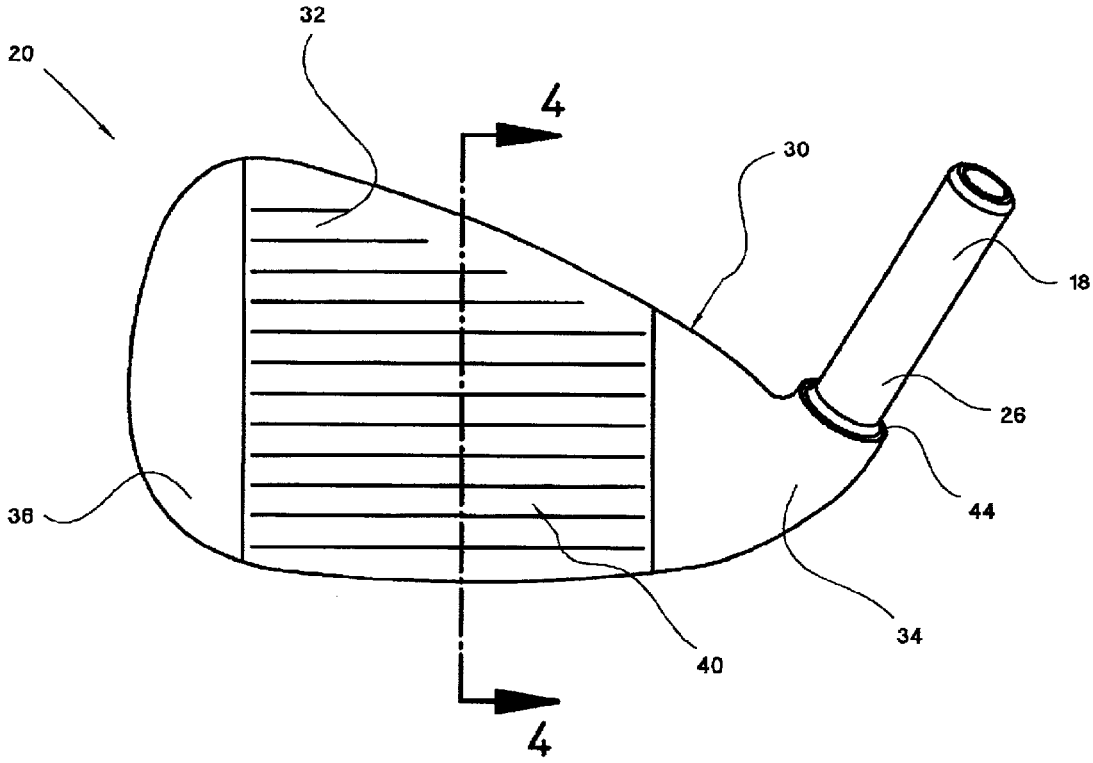
FIG. 3 is a front perspective view of the club head of FIG. 2.
Figure 4:
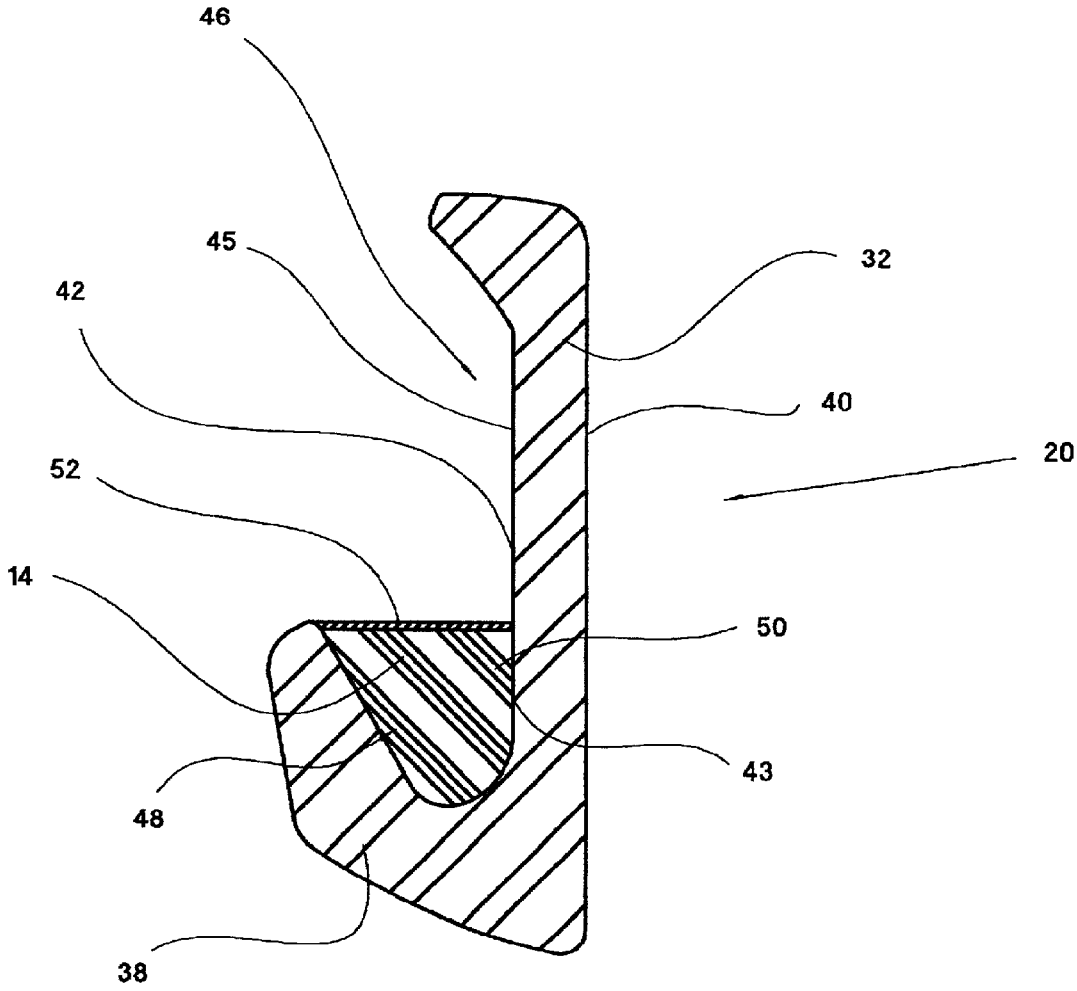
FIG. 4 is a cross-sectional view of the club head taken along line 4—4 of FIG. 3.

Referring to FIGS. 2 through 4, the club head 20 is shown in greater detail. The club head 20 includes a main body 30 having a front wall 32, a heel 34, a toe 36, and a sole portion 38. The front wall 32 is a generally planar member outwardly extending from the heel 34 of the body 30 to the toe 36 of the body 30. The front wall 32 has a rearwardly sloped front strike face 40 (See FIG. 3) and an opposing rear side 42. The rear side 42 has a lower region 43 and an upper region 45. The heel 34 includes a hosel 44. In a preferred embodiment, the hosel 44 has a hole for receiving the distal end 26 of the shaft 18. In alternative preferred embodiment, the hosel includes an upwardly extending projection for engaging the distal end 26 of the shaft 18.

Referring to FIGS. 2 and 4, the sole portion 38 rearwardly extends from the lower region 43 of the rear side 42 of the front wall 32. The rear side 42 and the sole portion 38 define a forwardly extending cavity 46 that is generally open in a rearward direction. The rear side 42 and the sole portion 38 further define a recess 48 that downwardly extends into the sole portion 38. The downwardly extending recess 48 is generally open in an upward direction. The cavity 46 extends into and interconnects with the recess 48. The cavity 46 and the recess 48 reduce the thicknesses of a portion of the front wall 32 and a portion of the sole portion 38 without negatively effecting the structural integrity of the club head 18. These thinner portions of the front wall 32 and the sole portion 38 enable the club head 18 to more easily deflect or spring back during impact with a golf ball thereby improving the club head's performance. Specifically, the thinner portions of the front wall 32 and the sole portion 38 increase the coefficient of restitution of the club head 18 enabling the club head to propel a ball further upon impact than conventional club heads having a uniformly thick front wall and sole portion.

The insert assembly 14 is positioned in and substantially fills the recess 48, such that the upper region 45 of the rear side 42 is openly exposed and uncovered. Alternatively, the insert assembly 14 can be formed and positioned in the club head 20 to only partially fill the recess 48. The insert assembly 14 is affixed to the club head 20 with an adhesive, preferably an ethyl cyanoacrylate adhesive. One such adhesive is a Product 496 produced by Loctite Corporation of Rocky Hill, Conn. In alternative embodiments, the insert assembly 14 can be attached to the club head 20 through other means, such as, for example, other adhesives, one or more fasteners, a mechanical latch, or a press-fit connection. Through contact with the inner surfaces of the sole portion 38 and the lower region 43 of the rear side 42, the insert assembly 14 absorbs and dissipates a portion of the vibrational energy produced during impact of the club head 20 with a golf ball. The resiliency of the insert assembly 14 allows the insert assembly 14 to readily compress upon impact to absorb and draw away vibrational energy from the club head 20. The insert assembly 14 further serves to transfer a portion of the vibrational energy produced from impact into heat that readily dissipates through the outer surfaces of the insert assembly 14 including its upper exposed surface. The absorption and dissipation of vibrational energy by the insert assembly 14 results in an improved feel for the user and a cleaner, more solid impact sound.

Referring to FIG. 4, one preferred embodiment of the insert assembly 14 is shown. Specifically, the insert assembly 14 of FIG. 4 is comprised of a unitary insert 50 and a cap 52. The unitary insert 50 is formed of a lightweight, resilient, tough, weather-resistant material, preferably a thermoplastic urethane. The material of the unitary insert 50 preferably has a durometer of between 20 on a Shore A hardness scale and 75 on a Shore D hardness scale. Shore A and Shore D durometer values provided in this specification are in accordance with ASTM Standard D 2240 entitled, "Standard Test Method for Rubber Property—Durometer Hardness." In a particularly preferred embodiment, the material of the unitary insert 50 has a durometer of between 70 on a Shore A hardness scale and 60 on a Shore D hardness scale. Alternatively, the unitary insert 50 can be formed of other materials such as, for example, a plastic, a thermoplastic, a thermoset material, a polyurethane, an elastomer, nylon, polyvinyl chloride or combinations thereof.

Referring to FIGS. 2 and 4, the cap 52 is a thin plate that is attached to, and covers a portion of, an upper exposed surface of the insert assembly 14. The cap 52 is preferably affixed to the upper exposed surface of the insert assembly 14 by an adhesive. The cap 52 is not connected to the club head 18 but rather to the insert or inserts of the insert assembly 14. The cap 52 serves as a decorative cover and improves the aesthetics of the insert assembly 14 and the club head 20. The cap 52 is made of a lightweight material, preferably stainless steel. Alternatively, other materials, can be used, such as, for example, aluminum, nickel, sheet metal, tin or plastic. The cap 52 preferably includes a plurality of openings 54 enabling a user to see and touch the insert assembly 14. The cap 52 further includes a central recessed pocket 56 for displaying graphics or alphanumeric indicia.

Figure 5:
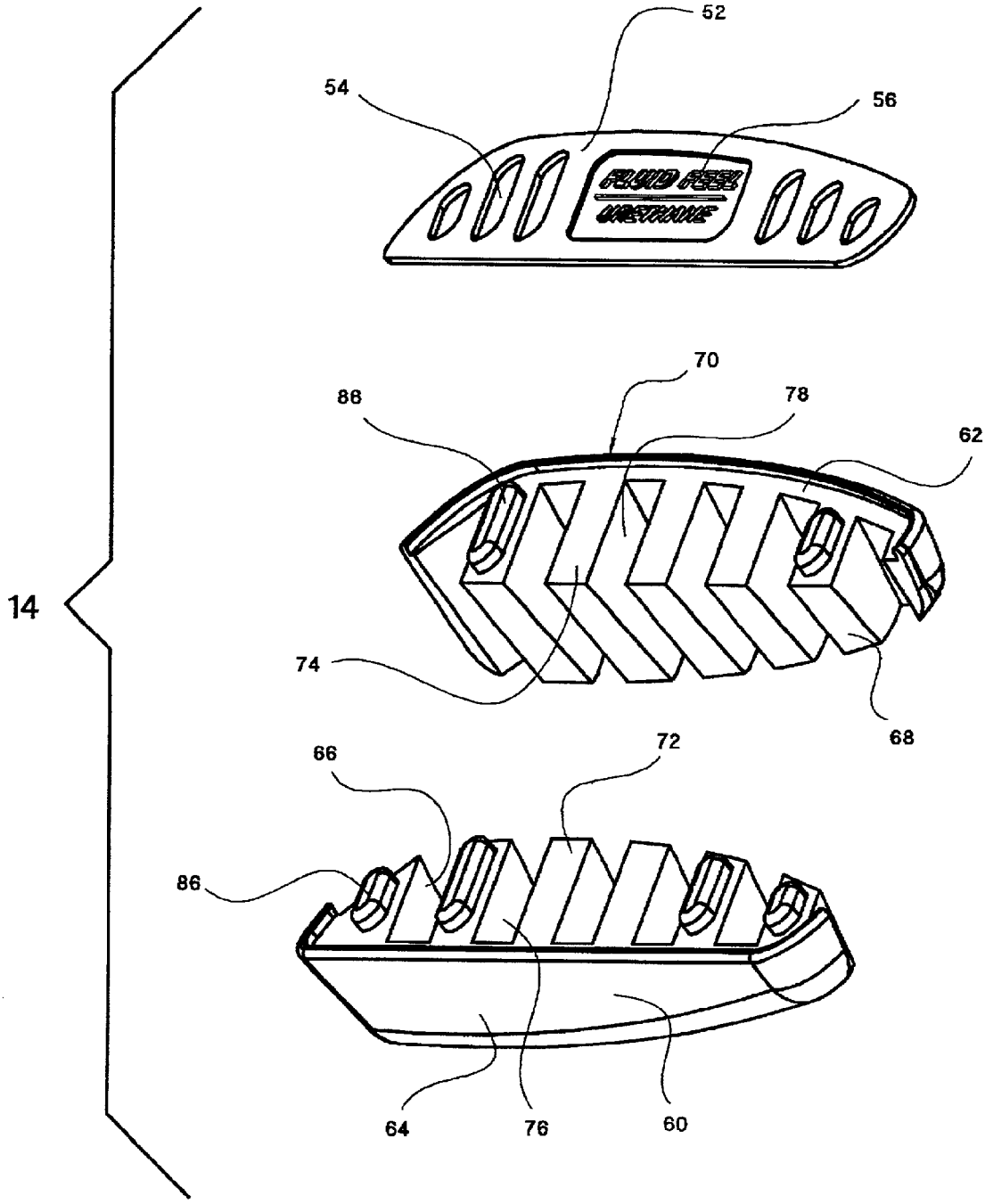
FIG. 5 is an exploded front top view of an insert assembly in accordance with alternative preferred embodiment of the present invention.
Figure 6:
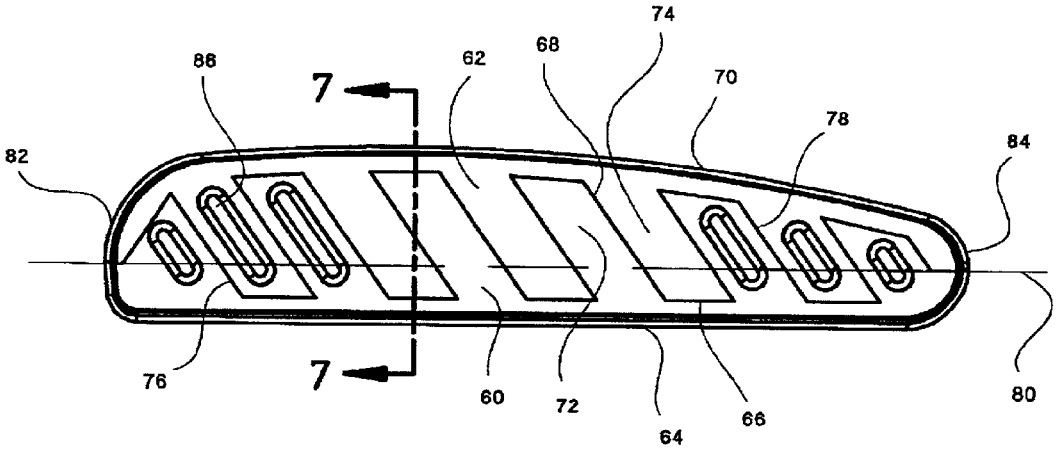
FIG. 6 is a top view of the insert assembly of FIG. 5 shown with the cap removed from the insert assembly.
Figure 7:
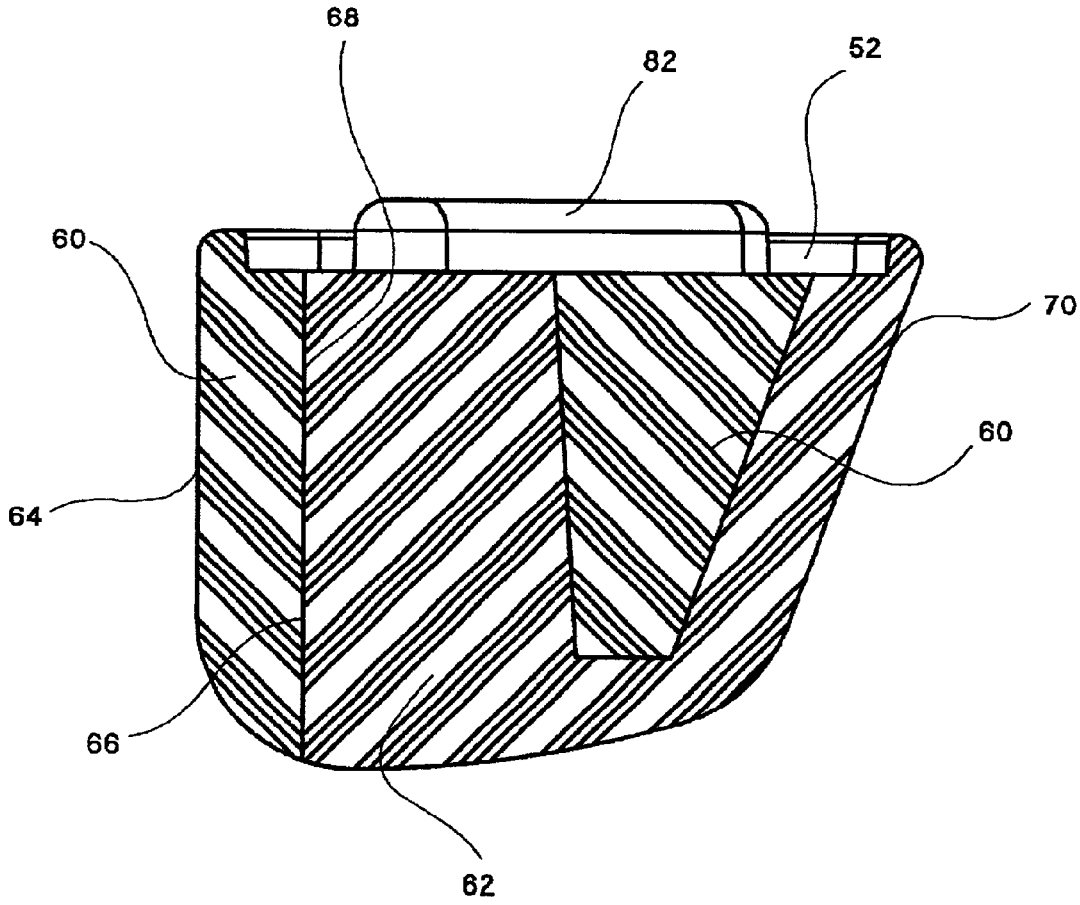
FIG. 7 is a cross-sectional view of the insert assembly taken along line 7—7 of FIG. 6.

Referring to FIGS. 5 through 7, an alternative preferred embodiment of the insert assembly 14 is illustrated. The insert assembly 14 preferably includes first and second inserts 60 and 62. The first insert 60 is configured to be positioned substantially forward of the second insert 62 within the recess 48 (See FIG. 4). The first insert 60 includes a first front surface 64 and a first rear surface 66, and the second insert 62 includes a second front surface 68 and a second rear surface 70. The reference numbers (for the first front 64, the first rear surface 66, the second front surface 68 and the second rear surface 70) and their associated reference number lines on FIGS. 5 and 6 refer to the entire surface (front or rear) of the respective insert indicated. The reference numbers and lines are not limited to the specific illustrated point of contact with the insert. The first front surface 64 and the second rear surface 70 are configured to substantially conform to the lower region 43 of the rear side 42 and to the back inner surface of the sole portion 38, respectively. The first rear surface 66 and the second front surface 68 are corresponding, irregularly contoured surfaces.

The first and second inserts 60 and 62 are formed of first and second materials, respectively, that are lightweight, resilient, tough and weather-resistant. The first material of the first insert 60 has a durometer that is greater than the durometer of the second material of the second insert 62. In an alternative embodiment, the second material can have a durometer that is greater than the durometer of the first material. In a preferred embodiment, the first material of the first insert 60 has a durometer of between 20 and 95 on a Shore A hardness scale, and the second material of the second insert 62 has a durometer of between 45 and 75 on a Shore D hardness scale. In a particularly preferred embodiment, the first material has a durometer of between 70 and 80 on a Shore A hardness scale and the second material of the second insert 62 has a durometer of between 50 and 60 on a Shore D hardness scale. The material and hardness differences of the first and second inserts 60 and 62 further serve to reduce and dissipate the vibrational energy generated by the club head 20 during impact with a golf ball. Also, the first and second materials of the first and second inserts 60 and 62 are preferably colorable such that the first and second inserts 60 and 62 can be formed in first and second colors, respectively.

In a preferred embodiment, the first rear surface 66 and the second front surface 68 each include at least one projection 72 and 74 and at least one indentation 76 and 78, respectively. The projections 72 and 74 and the indentations 76 and 78 are configured to matably engage one another. In a particularly preferred embodiment, the first insert 60 includes six rearwardly extending, angled projections 72 and five forwardly extending, angled indentations 76, and the second insert 62 includes five forwardly extending angled projections 74 and six rearwardly extending angled indentations 78. The projections 74, and most of the projections 72, preferably include two parallel sides and one distant side. The two parallel sides are preferably oblique with respect to a substantially vertical plane 80 extending through a toe end 82 and a heel end 84 of the insert assembly 14 (See FIG. 6). The distant side of each projection 72 and 74 is generally co-planar with the plane 80 and connects the two parallel sides. In alternative embodiments, one or more of the projections 72 and 74 and one or more of the indentations 76 and 78 can be formed in other shapes, such as, for example, squared, triangular, polygonal, arcuate or irregular.

The contoured surfaces of the first rear surface 66 and the second front surface 68, and, in particular, the projections 72 and 74 and indentations 76 and 78 of the first and second inserts 60 and 62 of the first rear surface 66 and the second front surface 68, respectively, increase the surface area in contact between the first and second inserts 60 and 62. This increased surface area of the first and second inserts 60 and 62 serves to further dissipate vibrational energy traveling through the club head 20 following impact with a golf ball. A portion of the vibrational energy generated during impact dissipates as it passes across the large surface areas of the first rear surface 66 and the second front surface 68.

The first and second inserts 60 and 62 can be produced through injection molding. In a preferred embodiment, the injection molding process includes the steps of molding the harder insert (preferably the second insert 62) and then molding the softer insert (preferably the first insert 60) around the harder insert. Under this process, the first and second inserts 60 and 62 can bond together at the first rear surface 66 and the second front surface 68. As such, the first rear surface 66 and the second front surface 68 can be placed into a shear condition when impact is made with the club head 18 and a ball. The preferred angled configuration of the projections 72 and 74 of the first rear surface 66 and the second front surface 68 further contribute to the development of a shear condition across the boundary of the first rear surface 66 and the second front surface 68. The vibrational energy generated from the impact of the club head 18 and the ball can be further dissipated as shear stress across the boundary of the first rear surface 66 and the second front surface 68.

In another preferred embodiment, the first and second inserts 60 and 62 are preferably not bonded together such that relative movement can be achieved between the first rear surface 66 of the first insert 60 and the second front surface 68 of the second insert 62. The lack of bonding between the first rear surface 66 of the first insert 60 and the second front surface 68 of the second insert 62 and the ability for the surfaces to move with respect to each other can further enhance the ability of the insert assembly 14 to dissipate vibrational energy.

Referring to FIG. 5, each of the first and second inserts preferably includes at least one upwardly extending rib 86. The ribs 86 are configured to upwardly extend through the openings 54 of the cap 52. The ribs 86 assist in securing the cap 52 in place on top of the insert assembly 54 and also upwardly protrude such that a user can see and touch the ribs 86 allowing the user to examine the texture, resiliency and hardness of the inserts.

Figure 8:
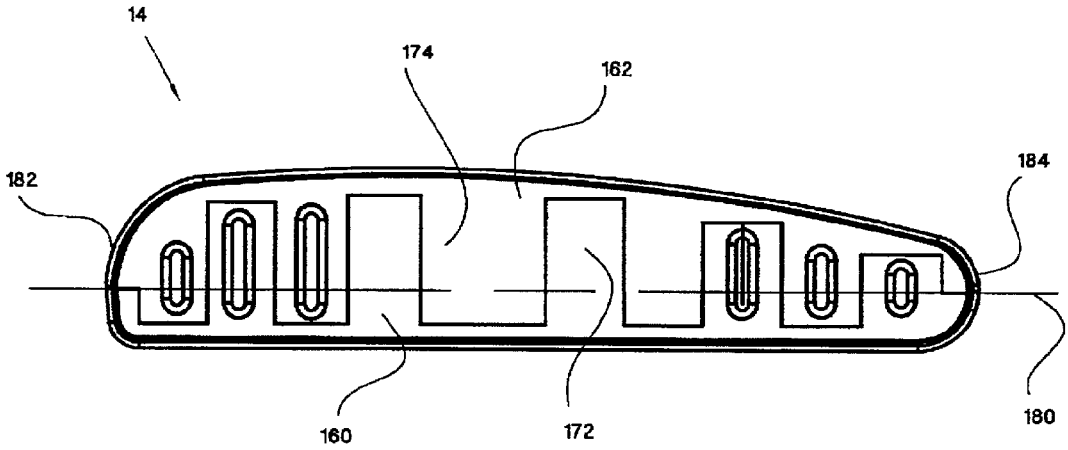
FIG. 8 is a top view of an insert assembly in accordance with another alternative preferred embodiment of the present invention.

Referring to FIG. 8, another alternative preferred embodiment of the insert assembly 14 is illustrated. The insert assembly 14 of FIG. 8 is comprised of a forward insert 160 and a rear insert 162. The forward and rear inserts 160 and 162 are generally identical to first and second inserts 60 and 62 of FIGS. 5 through 7 except that the forward and rear inserts 160 and 162 include "squared off" projections 172 and 174 and corresponding indentations 176 and 178. Each of the projections 172 and 174 generally includes two parallel sides that are generally perpendicular to a generally vertical plane 180 extending from a toe 182 to a heel 184 of the insert assembly 14 of FIG. 8, and a third line that is generally co-planar with the plane 180 and connects the two parallel lines. The forward and rear inserts 160 and 162 are preferably formed, similar to the first and second inserts 60 and 62, of different materials having different durometers. The projections 172 and 174 increase the surface area between the front and rear inserts 160 and 162. Additionally, the engaged surfaces of the front and rear inserts 160 and 162 are not bonded to one another and are capable of moving with respect to each other. The material differences between the front and rear inserts 160 and 162, the increased surface area created by the projections and indentations of the front and rear inserts 160 and 162, and the lack of bonding between the engaged surfaces of the front and rear inserts 160 and 162, all contribute to reducing and dissipating vibrational energy in the club head 20 during impact with a golf ball in a manner similar to the insert assembly 14 of FIGS. 5 through 7.

Figure 9:
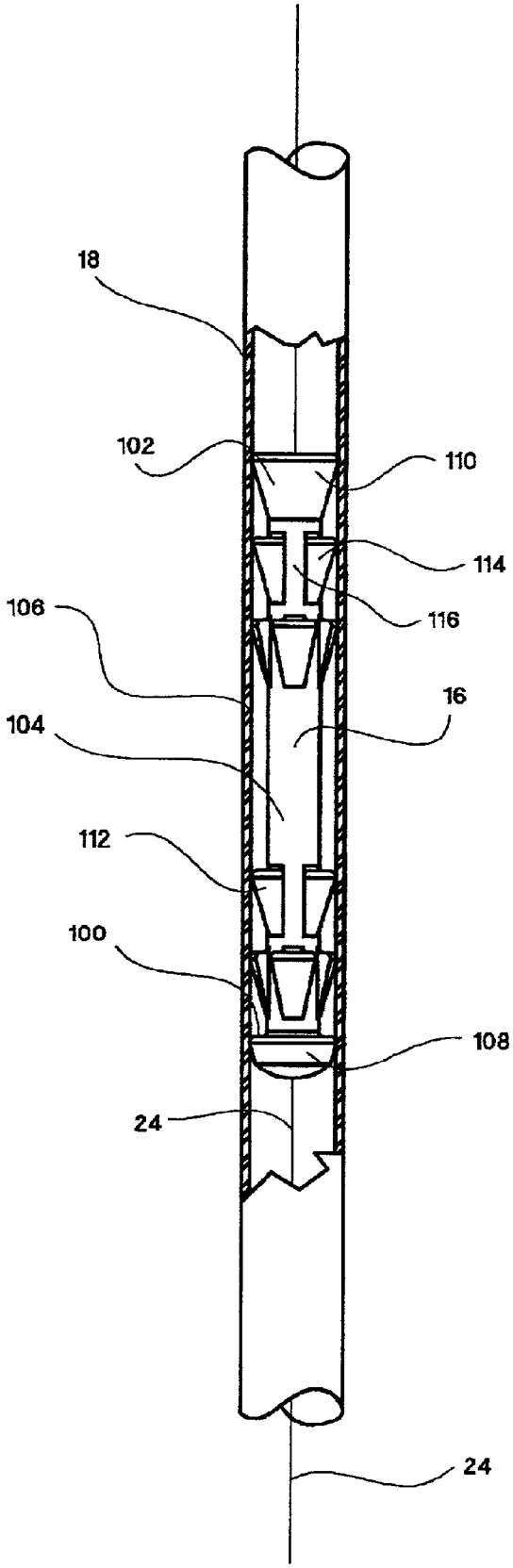
FIG. 9 is a sectional view of the shaft and a side view of the dampener of FIG. 1.
Figure 10:
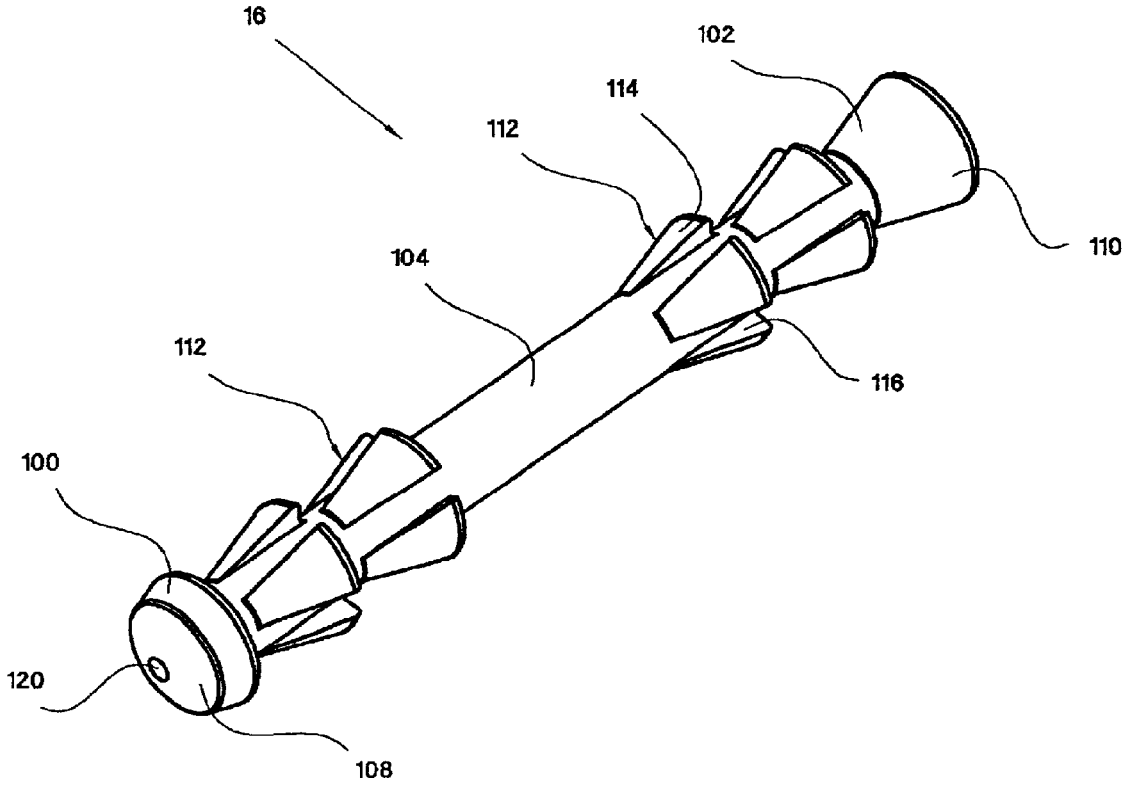
FIG. 10 is a side perspective view of the dampener of FIG. 9.

Referring to FIGS. 9 and 10, the golf club shaft dampener 16 is shown in greater detail. The dampener 16 is an elongate cylindrical member having a distal end portion 100, a proximal end portion 102 and an intermediate portion 104 between the distal and proximal end portions 102 and 104. The dampener 16 can be made in a variety of different lengths and different diameters to accommodate different shaft sizes (including different shaft lengths and diameters). In one preferred embodiment, the length of the dampener 16 is approximately 3.75 inches and the outer diameter is approximately 0.52 inches. Preferably, the dampener 16 is a one-piece dampener. The dampener 16 is slidably and securely inserted the shaft 18 from the proximal end portion 102. The dampener 16 is configured to bear against a portion of an inner surface 106 of the shaft 18 and remain in a fixed position within the shaft 18 during use. In a preferred embodiment, the dampener 16 is positioned between 26 inches and 30 inches from the proximal end 28 of the shaft 18. The dampener 16 is configured to draw away and reduce vibrational energy traveling up the hollow shaft 18 from the club head 20.

The dampener 16 is made of a resilient, lightweight material preferably an open cell, low density polyurethane foam. Alternatively, the dampener 16 can be formed of other materials such as, for example, other urethanes, rubber, a thermoplastic, an elastomer, a viscoelastic material and combinations thereof. In a preferred embodiment, the dampener 16 is made of a material having a durometer of between 30 and 75 on a Shore A hardness scale. In a particularly preferred embodiment, the dampener is made of a material having a durometer of between 55 and 65 on a Shore A hardness scale. The dampener 16 preferably weighs approximately 2.4 grams. Accordingly, the lightweight configuration of the dampener 16 results in a negligible increase in the weight of the shaft 18.

A bulbous head 108 outwardly extends from the distal end portion 100 of the dampener 16. The bulbous head 108 is rounded to facilitate insertion into the proximal end 28 of the shaft 18. The bulbous head 108 further radially extends from the distal end portion 100 and forms a substantially continuous annular projection which, when inserted into the shaft 18, bears against the inside surface 106 of the shaft 18. In one embodiment, the outer diameter of the bulbous head 108 is approximately 0.520 inches. Other diameters are also contemplated. The substantially uniform annular contact of the bulbous head 108 with the inside surface of the shaft 18 is configured to draw away and dissipate vibrational energy, and in particular torsional vibrational energy, traveling along and up the shaft 18 following contact by the golf club 12 with a golf ball. Alternatively, the bulbous head 108 can be formed in other shapes such as, for example, tapered, conical, and spherical.

The proximal end portion 102 of the dampener 16 includes an outwardly extending frusto-conical shaped projection 110. The frusto-conical shaped projection 110 is outwardly tapered toward the proximal end 28 of the shaft 18 such that the outer diameter of the frusto-conical shaped projection 110 is smaller at its distal end than at its proximal end. The projection 110 preferably outwardly radially extends from the proximal end portion 102 such that substantially uniform annular contact is made with at least a portion of the projection 110 and the inside surface 106 of the shaft 18. In one preferred embodiment, the outer diameter of the frusto-conical shaped projection 110 is approximately 0.520 inches. Other diameters are also contemplated. The annular contact by the projection 110 with the inside surface 106 of the shaft 18, like the bulbous head 108, is configured to draw away and dissipate vibrational energy, and in particular torsional vibrational energy, traveling along and up the shaft 18 following contact by the golf club 12 with a golf ball. The frusto-conical shape of the projection 110 is configured to secure the dampener 16 in position within the shaft 18 and to prevent the dampener 16 from moving within, or backing out of, the shaft 18 during use. Alternatively, the projection 110 can be formed in other shapes such as, for example, rounded or spherical. In another alternative embodiment, the frusto-conical shape of the projection can be reversed such that it is outwardly tapered in the direction of the distal end of the dampener 16.

The intermediate portion 104 of the dampener 16 includes at least one grouping of fins 112. Each grouping of fins 112 is preferably uniformly positioned about the axis 24. Each grouping of fins 112 includes at least two individual outwardly extending fins 114 and, preferably, four fins 114. The fins 114 are preferably radially spaced apart from each other about the perimeter of the intermediate portion 104. The radially spaced apart fins 114 define a plurality of longitudinally extending slots 116 between the fins 114. Each fin 114 is preferably outwardly tapered toward the proximal end portion 102. The tapered configuration of the fins 114 assist in securing the dampener 16 within the shaft 18 and preventing the dampener 16 from moving within, or backing out of, the shaft 18 during use.

The intermediate portion 104 preferably includes at least one pair of groupings of fins 112. The pair of groupings 112 of fins are preferably positioned in a stacked configuration such that the distal end of a first grouping of fins is adjacent a proximal end of a second grouping of fins. The pair of groupings of fins 112 is coaxially positioned about the axis 24 and is preferably positioned in a staggered position with respect to each other such that no two slots 116 in a pair of groupings of fins 112 are colinear. In the staggered configuration, each fin 114 contacts a different angular region of the inner surface of the shaft 18. Collectively, the fins 114 of each pair of groupings of fins 112 contact 360 degrees of the inner surface of the shaft 18. In a particularly preferred embodiment, the dampener 16 includes two pairs of groupings of fins 112 wherein the groupings of fins 112 are positioned in a coaxial, staggered position. The groupings of fins 112 are configured to draw away and dissipate vibrational energy, and in particular longitudinal vibrational energy, traveling along and up the shaft 18 following contact by the golf club 12 with a golf ball.

Steel shafts are typically made from a sheet of steel that is subsequently rolled to form a tube having a longitudinally extending seam. The shaft typically undergoes additional metallurgical processing, such as annealing, to substantially eliminate the seam and to provide a substantially uniform shaft. However, the seam may still effect the vibrational characteristics of a particular shaft. Because the location of the seam on a fully processed shaft can not typically be readily determined, the use of annular projections and the staggering of the groupings of fins 112 about the perimeter of dampener 16 ensures that the dampener 16 bears against the entire inside diameter of the shaft at at least one location to more uniformly dampen and dissipate the vibration traveling along the shaft.

Figure 11:
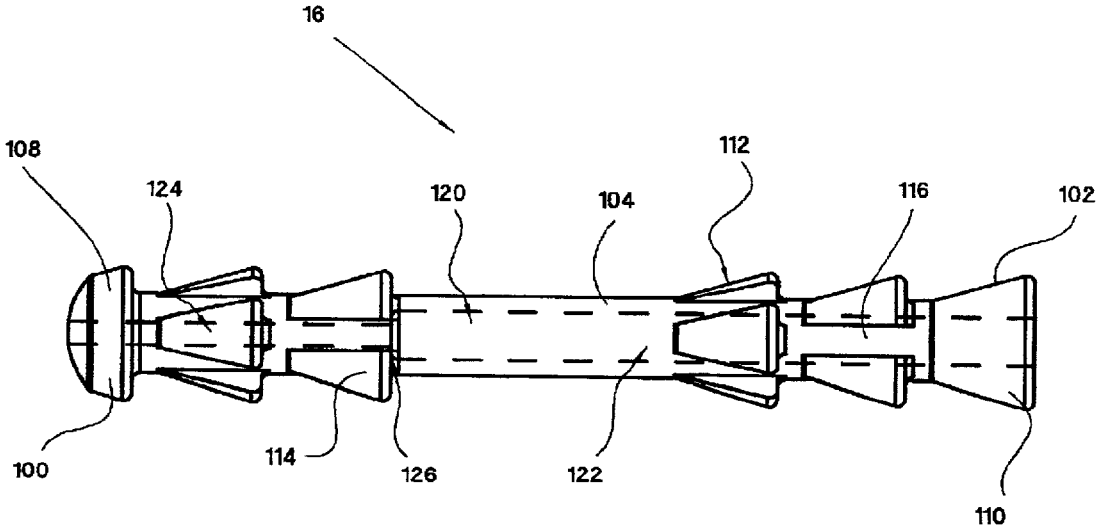
FIG. 11 is a longitudinal cross-sectional view of the dampener of FIG. 9.

Referring to FIG. 11, the dampener 16 is shown in greater detail. Specifically, a bore 120 longitudinally extends from the distal end portion 100 to the proximal end portion 102 of the dampener 16. The bore 120 facilitates the compression and installation of the dampener 16 within the shaft 18. In a preferred embodiment, the bore 120 is a stepped bore having a large diameter portion 122 extending through the proximal end portion 102 and a portion of the intermediate portion 104, and a small diameter portion 124 extending through the remainder of the intermediate portion 104 and the distal end portion 100 of the dampener 16. An inwardly extending annular ridge 126 is formed at the transition of the stepped bore 120 from the large diameter portion 122 to the small diameter portion 124. The wall thickness of the dampener 16 at the small diameter portion 124 of the bore 120 is greater than the wall thickness at the large diameter portion 122. Accordingly, the dampener 16 is stiffer and less compressible at the small diameter portion 124 of the dampener 16 than at the large diameter portion 120 of the dampener 16. This variation in compressibility contributes to the vibration dampening characteristics of the dampener 16.

The dampener 16 is configured to be easily installed in either new or existing used clubs. For new clubs, the dampener 16 can be installed within the shaft 18 after, or preferably before, the club head 120 is affixed to the distal end 26 of the shaft 18. The bore 120 and the slots 116 defined within the dampener 16 and the open cell foam construction of the dampener 16 assist in enabling air and other gases to easily pass through the dampener 16. When the club head 20 is installed on the distal end 26 of the shaft 18 prior to the dampener 16, the bore 120 and the slots 116 facilitate installation of the dampener 16 by enabling entrapped air within the shaft 18 to pass through the dampener 16 as it is lowered into the shaft 18.

The dampener 16 conforms with USGA rules. The dampener 16 increases the natural dampening of the shaft 18 and reduces the standard deviation of the vibrational energy traveling along the shaft 18. The result is an improved feel for the user. Further, the dampener 16 substantially eliminates undesired sounds emanating from the shaft 18 following impact with a golf ball, such as ringing noises or unusually loud noises. The dampener 16 in conjunction with the insert assembly 14 maximizes the vibration reduction and sound attenuation of the golf club 12 without negatively affecting the performance of the club 12.

In alternative embodiments, the dampener 16 can be formed of two or more pieces, such as, for example, a distal piece, a proximal piece, and an intermediate piece, or an inner piece and at least one outer piece. In another alternative embodiment, the dampener can be formed without a bore. In yet another alternative embodiment, the dampener can be formed with only one bulbous head, frusto-conical projection or grouping of at least two fins. In another alternative embodiment, the dampener can include any combination of one or more bulbous heads, the frusto-conical projections or groupings of at least two fins.

Figure 12:
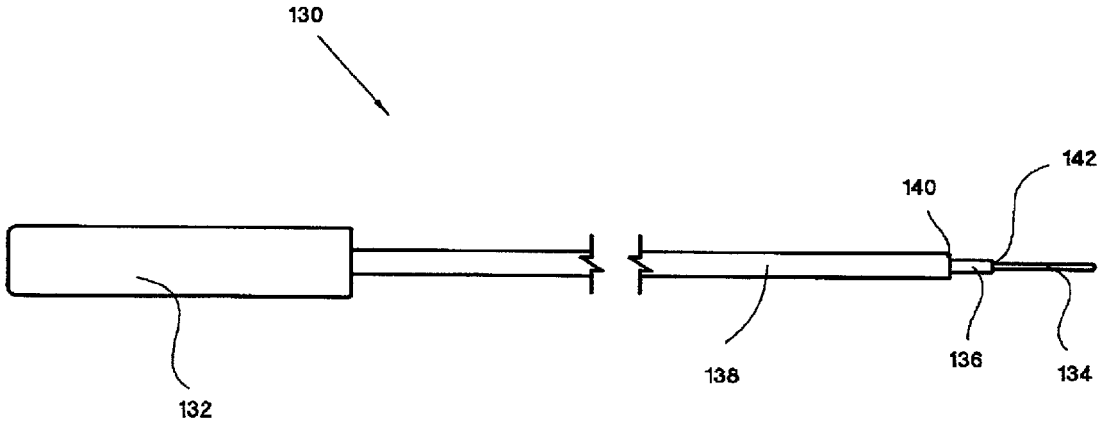
FIG. 12 is a side view of a tool for installing a dampener within a shaft according to a preferred embodiment of the present invention.

Referring to FIG. 12, a tool 130 for installing the dampener 16 within the shaft 18 is illustrated. The tool 130 is an elongate structure having a handle portion 132, a distal pin portion 134, a central pin 136 portion, and an extension portion 138. The extension portion 138 is connected at one end to the handle portion 132, which includes a conventional handle. The extension portion 138 is attached at its other end to the central pin portion 136 at a first transition region 140. The central portion 136 attaches to the distal pin portion 134 at a second transition region 142. The distal pin portion 134 and the central pin portion 136 are removably inserted into the bore 120 of the dampener 16. The distal pin portion 134 is sized to extend into the small diameter portion 122 of the dampener 16 and the central pin portion 136 is sized to extend through the large diameter portion 124 of the dampener 16 but not the small diameter portion 122 such that the second transition region 142 of the tool 130 contacts the annular ridge 126 of the dampener 16. The extension portion 138 is sized to fit within the shaft 18 and to exceed the diameter of the bore 120 such that the first transition region 140 of the tool 130 bears against the proximal end portion 102 of the dampener 16.

A user installs the dampener 16 within the shaft 18 by placing the distal pin portion 134 and the central pin portion 136 through the proximal end portion 102 of the dampener 16 until the first and second transition regions 140 and 142 bear against the proximal end portion 102 and the annular ridge 126 of the dampener 16, respectively. The user then continues inserts the tool 130 into the shaft 18 until the dampener 16 reaches the desired location within the shaft 18. Once the dampener 16 reaches the desired location within the shaft 18, the user simply removes the tool 130 from the shaft 18. The configuration of the dampener 16 holds it in place within the shaft 18. A lubricant, such as corn huskers oil, can be used during the installation of the dampener 16 into the shaft. The tool 130 enables a user to quickly and easily install the dampener 16 within the shaft 18 without damaging the dampener 16 or the shaft 18.

While the preferred embodiments of the present invention have been described and illustrated, numerous departures therefrom can be contemplated by persons skilled in the art, for example, the insert assembly can be comprised of three or more inserts. Therefore, the present invention is not limited to the foregoing description but only by the scope and spirit of the appended claims.

What is claimed is:

1. A golf club head comprising:

a front wall including a rearwardly sloped front strike side and a rear side, the rear side having an upper region and a lower region which are generally coplanar with respect to each other;

a sole portion rearwardly extending from the lower region of the rear side, the sole portion including an upwardly extending rear wall having a forwardly facing inner surface, the rear side and the sole portion defining a forwardly extending cavity, the lower region of the rear side of the front wall and the sole portion, including the rear wall, defining a non-through sole portion recess, the recess downwardly extending into the sole portion and interconnected with the cavity, the recess being open in an upward direction and having variable rearward depth, the forwardly facing inner surface of the rear wall being substantially non-parallel, and rearwardly sloped with respect, to the lower region of the rear side of the front wall such that the rearward depth of recess is greatest at its upper open end; and a resilient insert assembly positioned in and substantially filling the recess, the insert assembly coupled to at least one of the sole portion and the lower region of the rear side, the upper region of the rear side being generally uncovered, the insert assembly being fabricated of at least one material, the material having a durometer of between 20 on a Shore A hardness scale and 75 on a Shore D hardness scale.

2. The golf club head of claim 1 wherein the at least one material has a durometer of between 70 on a Shore A hardness scale and 60 on a Shore D hardness scale.

3. The golf club head of claim 1 wherein the insert assembly includes at least first and second inserts.

4. The golf club head of claim 3 wherein the first insert is positioned substantially forward of the second insert within the recess.

5. The golf club head of claim 3 wherein the first and second inserts are made of first and second materials respectively and wherein the second material has a durometer that is greater than the durometer of the first material.

6. The golf club head of claim 5 wherein the first material has a durometer of between 70 and 80 on a Shore A hardness scale and wherein the second material has a durometer of between 50 and 60 on a Shore D hardness scale.

7. The golf club head of claim 3, wherein the first insert includes a first rear surface and the second insert includes a second front surface and wherein the first rear surface engages the second front surface.

8. The golf club head of claim 7 wherein the first rear surface of the first insert has at least one rearwardly extending projection and defines at least one forwardly extending indentation and wherein the second front surface of the second insert has at least one corresponding forwardly extending projection and defines at least one corresponding rearwardly extending indentation.

9. The golf club head of claim 8 wherein the at least one rearwardly extending projection and the at least one forwardly extending projections each have an end shape selected from the group consisting of a squared end, a triangular end, an arcuate end, a polygonal end, irregular end and combinations thereof.

10. The golf club head of claim 3 wherein the first and second inserts are each formed of a material selected from the group consisting of a thermoplastic, a thermoset material, an elastomer, a urethane, a polyurethane, a plastic and combinations thereof.

11. The golf club head of claim 1 wherein the insert assembly is affixed to at least one of the sole portion and the lower region of the rear side.

12. The golf club head of claim 1 wherein the insert assembly has an exposed surface and wherein the insert assembly includes a cap covering at least a portion of the exposed surface.

13. A golf club head comprising:

a front wall including a rearwardly sloped front strike side and a rear side, the rear side having an upper region and a lower region which are generally coplanar with respect to each other;

a sole portion rearwardly extending from a lower region of the rear side, the sole portion having a lower surface that is substantially entirely continuous, the sole portion including an upwardly extending rear wall having a forwardly facing inner surface, the rear side and the sole portion defining a forwardly extending cavity, the lower region of the rear side of the front wall and the sole portion, including the rear wall, defining a recess, the recess interconnected with the cavity and downwardly extending into the sole portion, the recess being open in an upward direction and having variable rearward depth, the forwardly facing inner surface of the rear wall being substantially non-parallel, and rearwardly sloped with respect, to the lower region of the rear side of the front wall such that the rearward depth of recess is greatest at its upper open end;

a first insert; and a second insert contacting the first insert, the first and second inserts positioned only in, and collectively substantially filling, the recess, at least one of the first and second inserts attached to at least one of the sole portion and the lower region of the rear side, the first and second inserts made of first and second elastomeric materials, respectively.

14. The golf club head of claim 13 wherein the first insert has a first rear surface, wherein the second insert has a second front surface, and wherein the first rear surface matably engages the second front surface.

15. The golf club head of claim 14 wherein the first rear surface of the first insert has at least one rearwardly extending projection and defines at least one forwardly extending indentation and wherein the second front surface of the second insert has at least one forwardly extending projection and defines at least one rearwardly extending indentation.

16. The golf club head of claim 15 wherein the at least one rearwardly extending projection and the at least one forwardly extending projections each have an end shape selected from the group consisting of a squared end, a triangular end, an arcuate end, a polygonal end, irregular end and combinations thereof.

17. The golf club head of claim 13 wherein the first and second inserts are each formed of a material selected from the group consisting of a thermoplastic, a thermoset material, an elastomer, a urethane, a polyurethane, a plastic and combinations thereof.

18. The golf club head of claim 13 wherein the insert assembly has an exposed surface and wherein the insert assembly includes a cap covering at least a portion of the exposed surface.

19. A golf club head comprising:

a front wall including a rearwardly sloped front strike side and a rear side, the rear side having an upper region and a lower region which are generally coplanar with respect to each other, the lower region of the rear side being substantially parallel to the front strike side;

a sole portion rearwardly extending from the lower region of the rear side, the sole portion including an upwardly extending rear wall having a forwardly facing inner surface, the rear side defining a forwardly extending cavity, the lower region of the rear side of the front wall, the forwardly facing inner surface of the rear wall of the sole portion and the sole portion defining a non-through sole portion recess, the recess interconnected with the cavity and being open only in an upward direction, the forwardly facing inner surface of the rear wall being substantially non-parallel, and rearwardly sloped with respect, to the lower region of the rear side of the front wall; and a resilient insert assembly positioned in and substantially filling the recess, the insert assembly coupled to at least one of the sole portion and the lower region of the rear side, the upper region of the rear side be generally uncovered.

20. The golf club head of claim 19 wherein the insert assembly is fabricated of at least one material, and wherein the material has a durometer of between 20 on a Shore A hardness scale and 75 on a Shore D hardness scale.

21. The golf club head of claim 20 wherein the at least one material has a durometer of between 70 on a Shore A hardness scale and 60 on a Shore D hardness scale.

22. A The golf club head of claim 20 wherein the insert assembly includes first and second inserts, wherein the first and second inserts are made of first and second materials respectively, and wherein the second material has a durometer that is greater than the durometer of the first material.

23. The golf club head of claim 22 wherein the first material has a durometer of between 70 and 80 on a Shore A hardness scale and wherein the second material has a durometer of between 50 and 60 on a Shore D hardness scale.

24. The golf club head of claim 22 wherein the first and second inserts are each formed of a material selected from the group consisting of a thermoplastic, a thermoset material, an elastomer, a urethane, a polyurethane, a plastic and combinations thereof.

25. The golf club head of claim 19 wherein the insert assembly has an exposed surface and wherein the insert assembly includes a cap covering at least a portion of the exposed surface.

* * * * *